US009380825B2

(12) United States Patent
Duran

(10) Patent No.: US 9,380,825 B2
(45) Date of Patent: Jul. 5, 2016

(54) SHOE PRODUCT WITH REMOVABLE CUFF

(71) Applicant: Ada Duran, Merrick, NY (US)

(72) Inventor: Ada Duran, Merrick, NY (US)

(73) Assignee: Ada Duran, Merrick, NY (US)

( * ) Notice: Subject to any disclaimer, the term of this patent is extended or adjusted under 35 U.S.C. 154(b) by 252 days.

(21) Appl. No.: 14/072,083

(22) Filed: Nov. 5, 2013

(65) Prior Publication Data

US 2015/0121723 A1 May 7, 2015

(51) Int. Cl.

| | |
|---|---|
| ***A43B 3/24*** | (2006.01) |
| ***A43C 11/00*** | (2006.01) |
| ***A43B 3/00*** | (2006.01) |
| ***A43B 23/24*** | (2006.01) |
| *A43B 23/25* | (2006.01) |

(52) U.S. Cl.

CPC ..... *A43B 3/242* (2013.01); *A43B 3/0078* (2013.01); *A43B 3/24* (2013.01); *A43B 23/24* (2013.01); *A43B 23/25* (2013.01)

(58) Field of Classification Search

CPC ..... A43B 3/242; A43B 3/24; A43B 23/24; A43B 23/25; A43B 3/0078

USPC ..... 36/100, 101, 136, 132; D2/946, 978

See application file for complete search history.

(56) References Cited

U.S. PATENT DOCUMENTS

| | | | | | |
|---|---|---|---|---|---|
| 4,735,010 | A * | 4/1988 | Grinarml | A01M 31/008 | 239/36 |
| 6,131,312 | A * | 10/2000 | Hung | A43C 13/14 | 36/11.5 |
| 7,328,527 | B2 * | 2/2008 | Goldman | A43B 3/24 | 36/100 |
| 8,322,054 | B2 * | 12/2012 | Feller | A43B 1/0081 | 36/101 |
| 8,443,528 | B2 * | 5/2013 | Kann | A43B 3/16 | 36/101 |
| 8,479,415 | B2 * | 7/2013 | Berger | A43B 3/24 | 36/100 |
| 8,863,411 | B2 * | 10/2014 | Berger | A43B 3/24 | 36/101 |
| 2003/0089001 | A1 * | 5/2003 | Zagami | A43B 3/0078 | 36/72 R |

* cited by examiner

*Primary Examiner* — Jila M Mohandesi

(74) *Attorney, Agent, or Firm* — Moritt Hock & Hamroff LLP; Steven S. Rubin, Esq.

(57) ABSTRACT

Methods and products for forming a shoe product from a shoe are generally described. In an example, the shoe may include a first band, a top surface, a bottom surface, a front region, a middle region, and a heel region. A method for forming a shoe product from a shoe may include disposing a second band of a cuff adjacent to the first band of the shoe. The method may further include placing a strap of the cuff in a recess of the bottom surface of the shoe, The cuff may wrap around two edges in the front region of the shoe. The two edges may define a portion of a periphery of the front region of the shoe.

20 Claims, 4 Drawing Sheets

SHOE PRODUCT WITH REMOVABLE CUFF

BACKGROUND

Unless otherwise indicated herein, the materials described in this section are not prior art to the claims in this application and are not admitted to be prior art by inclusion in this section.

Shoe products may be formed by a combination of a shoe and one or more components. The one or more components may include decorations and/or accessories including different patterns. The combination of the shoe and the one or more components may be temporary or permanent.

SUMMARY

In some examples, methods for forming a shoe product from a shoe are generally described. The shoe may include a first band, a top surface, a bottom surface, a front region, a middle region, and a heel region. The methods may include disposing a second band of a cuff adjacent to the first band of the shoe. The methods may further include placing a strap of the cuff in a recess of the bottom surface of the shoe so that the cuff wraps around two edges in the front region of the shoe. The two edges may define a portion of a periphery of the front region of the shoe.

In some examples, shoe products formed from a shoe are generally described. The shoe products may include a shoe. The shoe may include a first band, a top surface, a bottom surface, a front region, a middle region, and a heel region. The front region may include two edges. The two edges may define a portion of a periphery of the front region of the shoe. The bottom surface may include a recess. The top surface may include a first band. The shoe products may further include a cuff. The cuff may include a strap and a second band. The second band may be disposed adjacent to the first band. The strap may be placed in the recess so that the cuff wraps around the two edges in the front region of the shoe.

In some examples, shoe products formed from a shoe are generally described. The shoe products may include a shoe. The shoe may include a first band, a top surface, a bottom surface, a front region, a middle region, and a heel region. The front region may includes two edges. The two edges may define a portion of a periphery of the front region of the shoe. The top surface may include a first band. The shoe product may further include an out-sole. The out-sole may include a first attachment and a second attachment. The first and second attachment may define a recess on the bottom surface of the shoe. The recess may include a groove. The shoe product may further include a cuff. The cuff may include a strap and a second band. The second band may be disposed adjacent to the first band. The strap may be placed in the groove so that the cuff wraps around two edges in the front region of the shoe.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
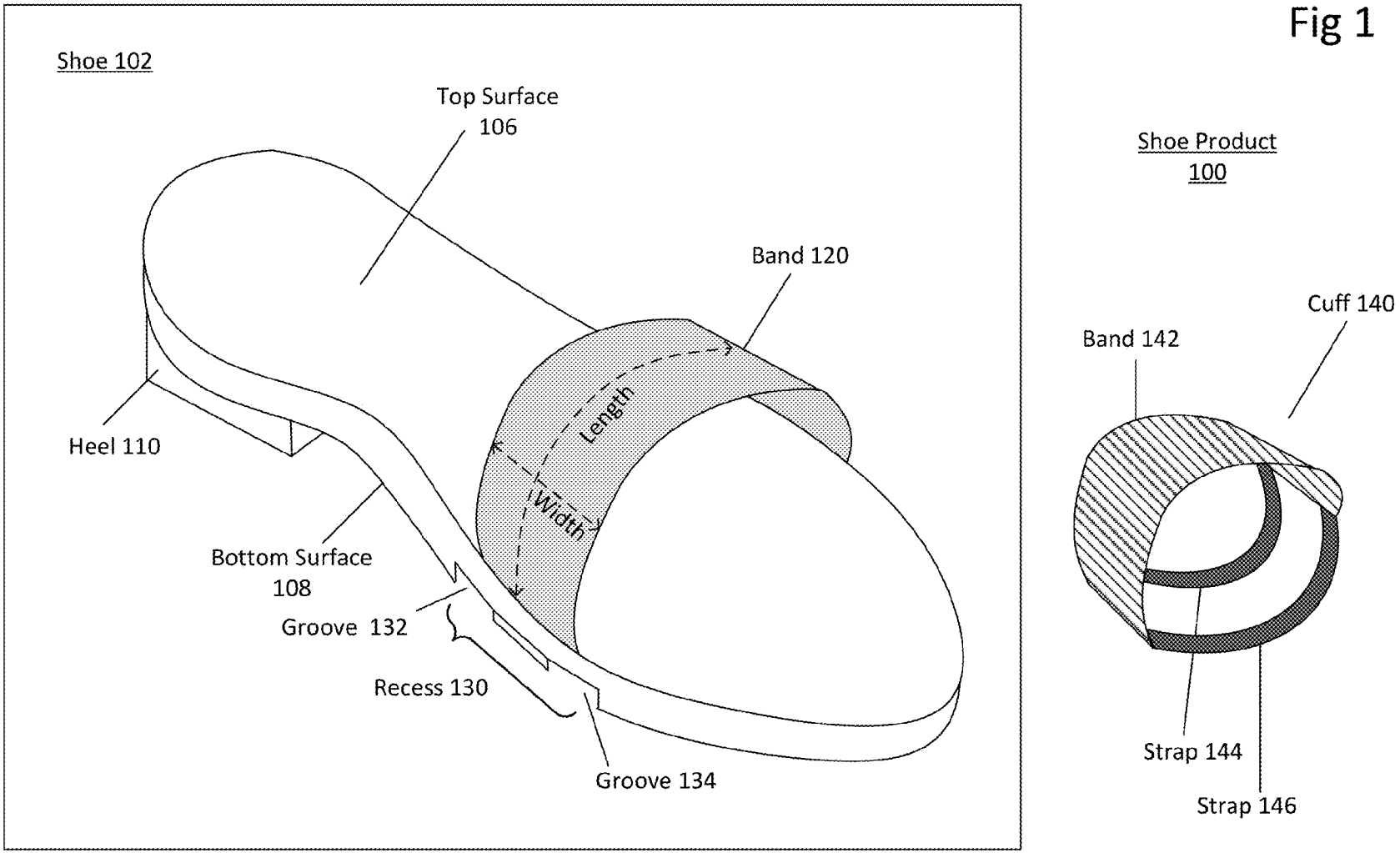
FIG. 1 illustrates a perspective view of shoe product with a removable cuff.

all arranged according to at least some embodiments described herein.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

FIG. 1 is a perspective view of a shoe product with a removable cuff, arranged in accordance with at least some embodiments described herein. Shoe product 100 may include a shoe 102 and a cuff 140. Shoe 102 may include a band 120, a top surface 106, a bottom surface 108, and a heel 110. In some examples, band 120 may be attached to top surface 106. Band 120 may be made of materials such as fabric, leather, etc. In some examples, band 120 may include non-slip features such as by including non-slip elastic webbing with polypropylene, silicone or rubber. Band 142 may further include additional elements such as decorations and/or accessories. Heel 110 may vary in shape and/or size. Bottom surface 108 of shoe 102 may include a recess 130. Recess 130 may include one or more grooves such as groove 132 and groove 134. A depth of groove 132 may be same or different from depth of groove 134.

Cuff 140 may include a band 142 and one or more straps such as strap 144 and strap 146. Band 142 may be made of materials such as fabric, leather, etc. In some examples, band 142 may include non-slip features such as by including non-slip elastic webbing with polypropylene, silicone or rubber. Band 142 and band 120 may be made of a same or different material. Band 142 may vary in shape and/or size such as length, and/or width. In some examples, band 142 may be larger than band 120 in length and/or width and have a larger surface area than band 120. Band 142 may further include additional elements such as decorations and/or accessories. Strap 144 and strap 146 may be made of elastic materials. A thickness of strap 144 and/or strap 146 may be less than a depth of recess 130, groove 132 and/or groove 134.

Figure 2:
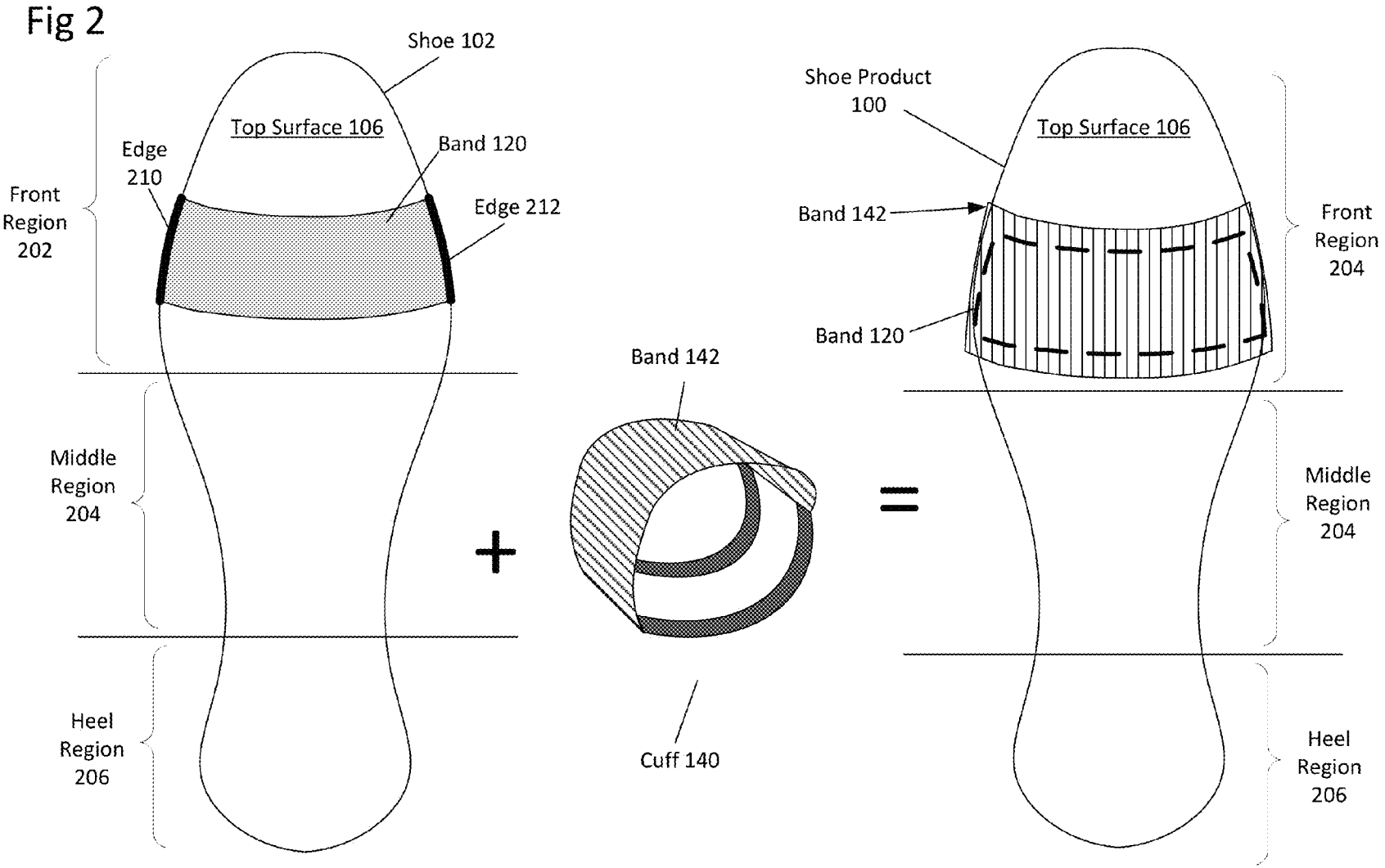
FIG. 2 illustrates a top view of the shoe product with a removable cuff.

FIG. 2 illustrates a top view of the shoe product with removable cuff, arranged in accordance with at least some embodiments described herein. FIG. 2 includes elements in FIG. 1, with additional details. Those elements in FIG. 2 that are labeled identically to elements of FIG. 1 will not be described again for the purposes of clarity.

Shoe 102 may include a front region 202, a middle region 204, and a heel region 206. Front region 202 of shoe 102 may include an edge 210 and an edge 212. Edge 210 and edge 212 may define a portion of a periphery of front region 202 of shoe 102. Shoe 102 may be combined with cuff 140 to form shoe product 100. In an example, cuff 140 may be wrapped around edge 210, edge 212, band 120, and/or recess 130 to form shoe product 100. Formation of shoe product 100 may further include disposing band 142 adjacent to band 120, such as aligning band 142 on top of band 120. In some examples, band 142 may be supported by a band 120 made of anti-slip materials. Viewing shoe product 100 from a top view, band 120 may be invisible after combining shoe 102 with shoe cuff 140. In some examples, band 120 may be visible after combining shoe 102 and shoe cuff 140.

Figure 3:
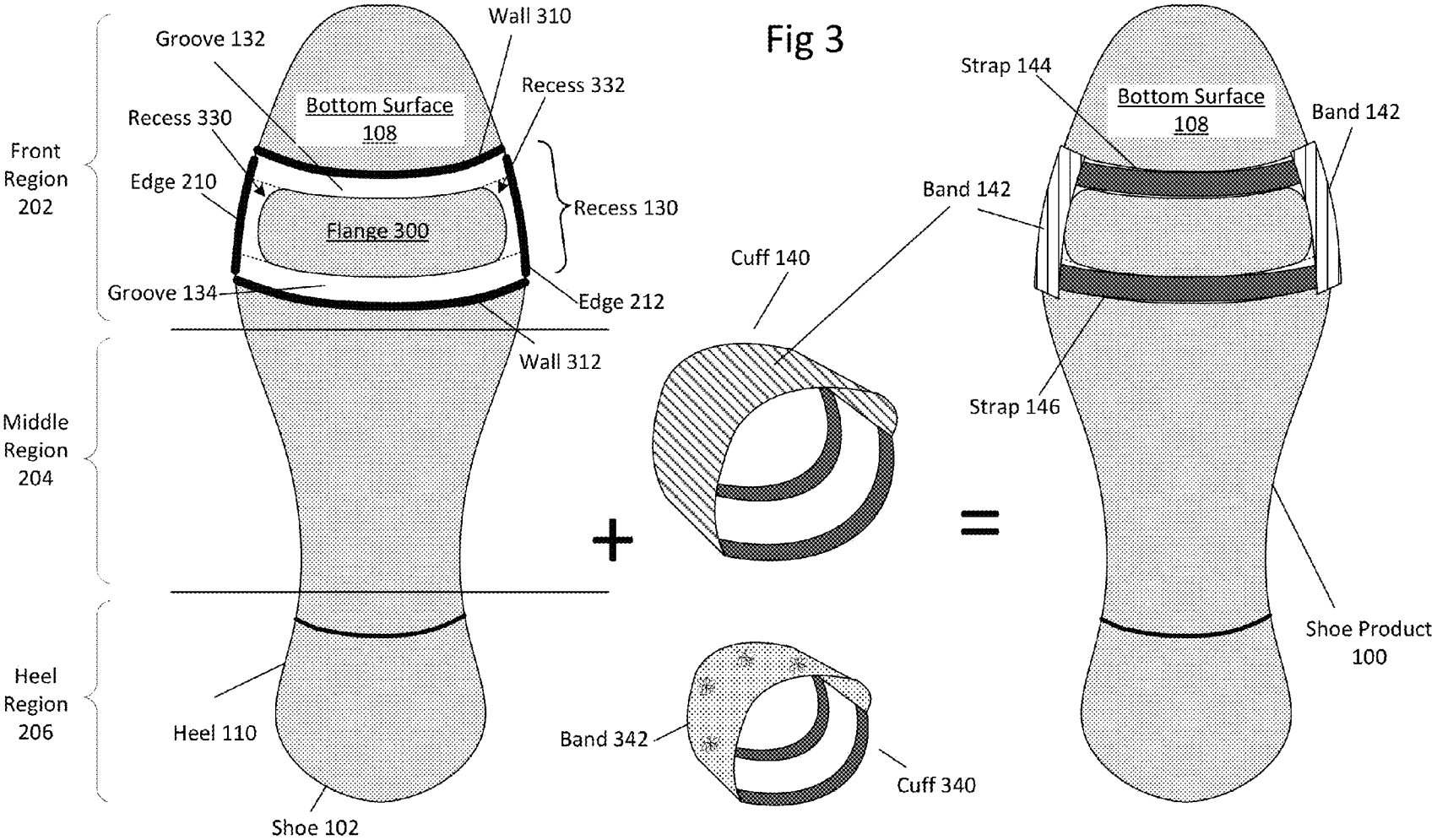
FIG. 3 illustrates a bottom view of the shoe product with removable cuff.

FIG. 3 illustrates a bottom view of the shoe product with removable cuff, arranged in accordance with at least some embodiments described herein. FIG. 3 includes elements in FIG. 1, with additional details. Those elements in FIG. 3 that are labeled identically to elements of FIG. 1 will not be described again for the purposes of clarity.

Recess 130 may be defined by a wall 310, a wall 312 and a flange 300. An area of flange 300 may be smaller than an area of recess 130. Flange 300 may be of an arbitrary size and/or shape. Wall 310 and wall 312 may be in front region 202 of shoe 102. A recess 330 may be defined by flange 300 wall 310, wall 312 and edge 210. A recess 332 may be defined by flange 300, wall 310, wall 312 and edge 212. Groove 132 may be defined by wall 310 and flange 300. Groove 134 may be defined by wall 312 and flange 300. In some examples, formation of shoe product 100 may further include respectively placing strap 144 and strap 146 into groove 132 and groove 134 of recess 130. In some examples, band 142 may not be visible from a bottom view of shoe product 100 after combining shoe 102 and cuff 140. In some examples, at least a portion of band 142 may be disposed in recess 330 and/or recess 332 so that band 142 may be visible from a bottom view of shoe product 100 after combining shoe 102 and cuff 140.

In an example, cuff 140 may be removed from shoe 102 such as by unwrapping cuff 140. Shoe 102 may be combined with a cuff 340 to form shoe product 100. Cuff 340 may include a band 342 where band 342 may be different from band 142 of cuff 140. In an example, cuff 340 may be wrapped around edge 210, edge 212, band 120, and/or recess 130 to form shoe product 100. Formation of shoe product 100 may further include disposing band 342 adjacent to band 120, such as aligning band 342 on top of band 120.

Figure 4:
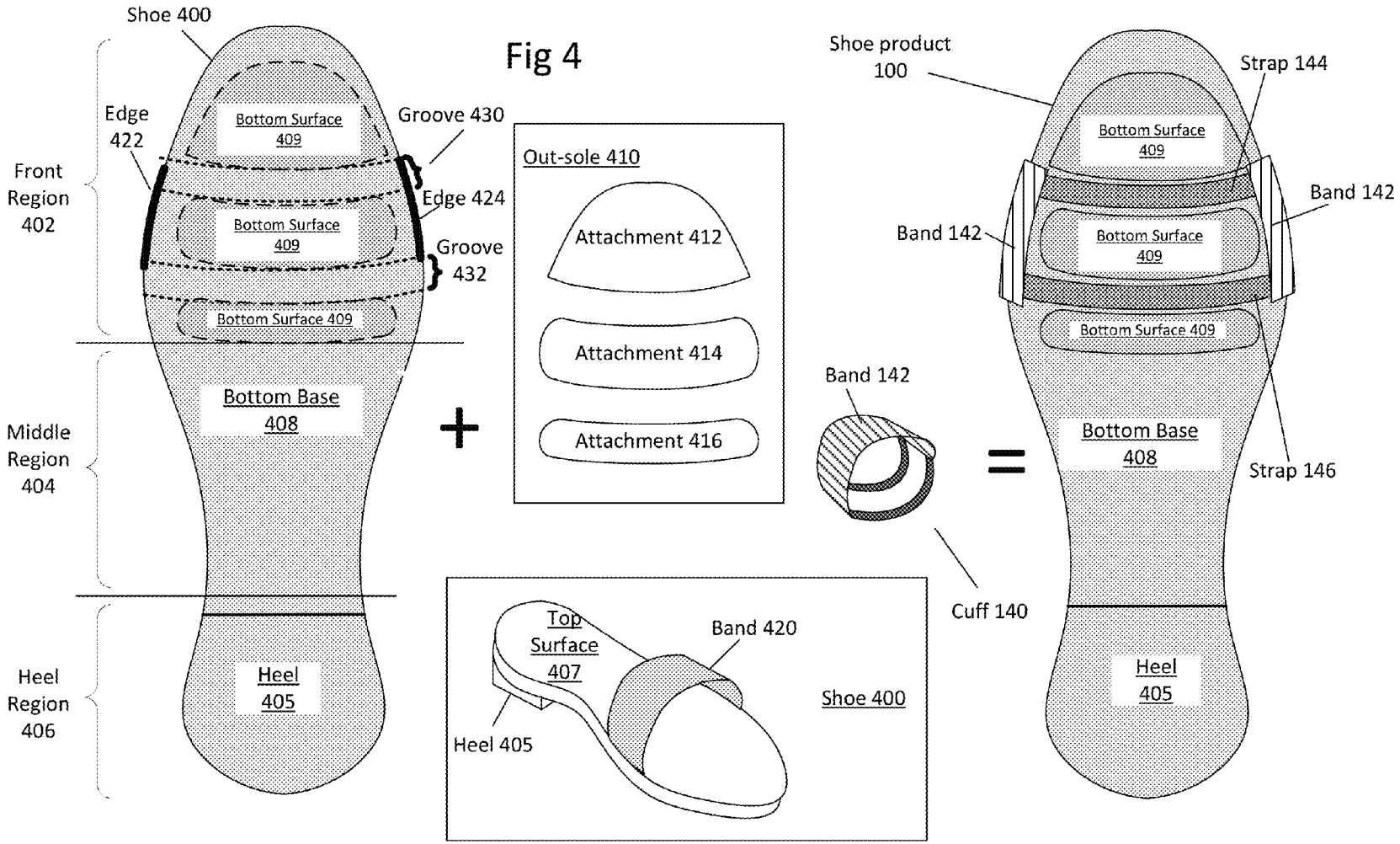
FIG. 4 illustrates another implementation relating to a shoe product with a removable cuff.

FIG. 4 illustrates another implementation relating to a shoe product with removable cuff, arranged in accordance with at least some embodiments described herein. FIG. 4 includes elements in FIG. 1, with additional details. Those elements in FIG. 4 that are labeled identically to elements of FIG. 1 will not be described again for the purposes of clarity.

Shoe product 100 may include a shoe 400, and cuff 140. Shoe 400 may include a band 420, a top surface 407, a bottom base 408, a bottom surface 409, a heel 405, a front region 402, a middle region 404, and a heel region 406. Front region 402 may include an edge 422 and an edge 424. Edge 422 and edge 424 may define a portion of a periphery of front region 402 of shoe 400. In some examples, bottom surface 409 may be of an arbitrary size and/or shape. Bottom surface 409 may be partitioned into two or more sections that define one or more grooves such as groove 430 and/or groove 432. In some examples, band 420 may be attached to shoe 400 on top surface 407. Band 420 may be made of materials such as fabric, leather, etc. In some examples, band 420 may include non-slip features such as by including non-slip elastic webbing with polypropylene, silicone or rubber. Heel 405 may vary in shape and/or size. Band 420 may further include additional elements such as decorations and/or optional accessories.

In an example, cuff 140 may be wrapped around edge 422 and edge 424 of shoe 400 to form shoe product 100. Band 142 of cuff 140 may be disposed adjacent to band 420, such as aligning band 142 on top of band 420. In some examples, formation of shoe product 100 may further include respectively placing strap 144 and strap 146 into groove 430 and groove 432. In some example, a thickness of straps 144, 146 may be less than a thickness of bottom surface 409. In some examples, band 142 may be supported by a band 420 made of anti-slip materials. When viewing shoe product 100 from a top view, band 420 may no longer be visible after a combination of shoe 400 and shoe cuff 140. In some examples, band 420 may be visible after combining shoe 400 and shoe cuff 140. Band 142 may be visible from a bottom view of shoe product 100 after a combination of shoe 400 and shoe cuff 140. In some examples, band 142 may not be visible from a bottom view of shoe product 100 after a combination of shoe 400 and cuff 140.

In an example, shoe product 100 may further include an out-sole 410. Out-sole 410 may include one or more attachments such as attachment 412, 414, 416. Attachments 412, 414, 416 may include adhesive materials. In some examples, bottom surface 409 may be defined by a combination of attachments 412, 414, 416 and bottom base 408 of shoe 400. Shoe 400 may be combined with out-sole 410 and cuff 140 to form shoe product 100. In an example, out-sole 410 may be attached to bottom base 408 of shoe 400 such as by attaching attachment 412, 414, 416 using adhesive materials. Attachment 412, 414, 416 may be attached to bottom base 408 and front region 402 of shoe 400. In an example, attachment 414 may be attached to bottom base 408 so that attachment 414 is positioned between attachment 412 and attachment 416. In an example, attachment 416 may be attached to bottom base 408 so that attachment 414 is positioned between attachment 414 and middle region 404. Attachment of attachment 412, 414, 416 on bottom base 408 may define a recess including a groove 430 and a groove 432. In some example, a thickness of straps 144, 146 may be less than a thickness of attachments 412, 414, 416.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for forming a shoe product from a shoe, the shoe comprising a sole, wherein the sole comprises, a top surface, a bottom surface, a front region, a middle region, and a heel region, the top surface includes a first band, the bottom surface includes a recess, the recess includes a first groove and a second groove, the front region includes two edges, wherein the two edges define a portion of a periphery of the front region of the sole, the method comprising:

disposing a cuff adjacent to the first band, wherein the cuff includes a second band of a first material, a first strap of a second material, and a second strap of the second material, wherein the second material is an elastic material, and disposing the cuff adjacent to the first band includes disposing the second band of the cuff adjacent to the first band such that the second band of the cuff aligns on top of, and encircles the first band, wherein the first band is invisible through the second band of the cuff; and placing the first strap of the cuff in the first groove of the recess in the bottom surface of the sole, and placing the second strap of the cuff in the second groove of the recess in the bottom surface of the sole, such that the cuff wraps around the two edges in the front region of the sole, and such that the cuff wraps around the first band.

2. The method of claim 1, wherein the recess is defined by a first wall and a second wall on the bottom surface of the sole.

3. The method of claim 2, wherein:

the first groove is defined by the first wall and a flange; and the second groove is defined by the flange and the second wall.

4. The method of claim 3, wherein an area of the flange is less than an area of the first and second groove.

5. The method of claim 1, wherein:

a thickness of the first strap and the second strap is less than a depth of the recess; and an area of the second band is larger than an area of the first band.

6. The method of claim 5, further comprising disposing at least a portion of the second band in the recess.

7. The method of claim 1, wherein the cuff is a first cuff, and the method further comprises:

removing the first cuff from the shoe;

disposing a third band of a second cuff adjacent to the first band of the shoe; and placing a third strap of the second cuff in the recess in the bottom surface of the sole so that the second cuff wraps around the two edges in the front region of the sole.

8. The method of claim 1, further comprising attaching an out-sole to the bottom surface of the sole, wherein the out-sole includes at least a first attachment and a second attachment effective to define the recess.

9. A shoe product comprising:

a shoe comprising a sole, the sole comprising a top surface, a bottom surface, a front region, a middle region, and a heel region, wherein:

the front region includes two edges that define a portion of a periphery of the front region of the sole;

the bottom surface includes a recess, wherein the recess includes a first groove and a second groove; and the top surface includes a first band;

a cuff that includes a first strap and a second strap, wherein the first and second straps are of a first material, the first material is an elastic material, and the cuff further includes a second band of a second material, wherein:

the second band of the cuff is disposed adjacent to the first band such that the second band of the cuff aligns on top of, and encircles the first band, wherein the first band is invisible through the second band of the cuff; and the first strap of the cuff is placed in the first groove of the recess, the second strap of the cuff is places placed in the second groove of the recess, such that the cuff wraps around the two edges in the front region of the sole, and such that the cuff wraps around the first band.

10. The shoe product of claim 9, wherein the recess is defined by a first wall and a second wall on the bottom surface of the sole.

11. The shoe product of claim 10, wherein:

the first groove is defined by the first wall and a flange inside of the recess; and the second groove is defined by the flange and the second wall.

12. The shoe product of claim 11, wherein an area of the flange is less than an area of the first and second grooves.

13. The shoe product of claim 9, wherein:

a thickness of the first strap and the second strap is less than a depth of the recess; and an area of the second band is larger than an area of the first band.

14. The shoe product of claim 13, wherein at least a portion of the second band is disposed in the recess.

15. The shoe product of claim 9, further comprising an out-sole attached to the bottom surface of the sole, wherein the out-sole includes at least a first attachment and a second attachment effective to define the recess.

16. A shoe product comprising:

a shoe comprising a sole, the sole comprising, a top surface, a bottom surface, a front region, a middle region, and a heel region, wherein:

the front region includes two edges that define a portion of a periphery of the front region of the sole;

the top surface includes a first band;

an out-sole including a first attachment and a second attachment, wherein the first and second attachment defines a recess that includes a first groove and a second groove on the bottom surface of the sole; and a cuff that includes a first strap and a second strap, wherein the first and second straps are of a first material, the first material is an elastic material, and the cuff further includes a second band of a second material, wherein:

the second band of the cuff is disposed adjacent to the first band such that the second band of the cuff aligns on top of, and encircle the first band, wherein the first band is invisible through the second band of the cuff; and the first strap of the cuff is placed in the first groove, the second strap of the cuff is placed in the second groove, such that the cuff wraps around two edges in the front region of the sole, and such that the cuff wraps around the first band.

17. The shoe product of claim 16, wherein:

the first attachment is attached to the bottom surface in the front region of the sole; and the second attachment is attached to the bottom surface in the front region of the sole and between the first attachment and the middle region of the sole.

18. The shoe product of claim 16, wherein:

the out-sole further includes a third attachment; and the second and third attachment defines the first and second grooves on the bottom surface of the sole.

19. The shoe product of claim 18, wherein the third attachment is attached to the bottom surface in the front region of the sole and between the second attachment and the middle region of the sole.

20. The shoe product of claim 16, wherein:

a thickness of the first and second straps is less than a thickness of the first and second attachment;

an area of the second band is larger than an area of the first band; and at least a portion of the second band is disposed in the recess.

* * * * *